US011387604B2

(12) United States Patent
Margrave et al.

(10) Patent No.: US 11,387,604 B2
(45) Date of Patent: Jul. 12, 2022

(54) WAVE CONNECTOR POSITION ASSURANCE LOCK WITH DUAL OVERLAP CONNECTOR LOCK

(71) Applicant: APTIV TECHNOLOGIES LIMITED, St. Michael (BB)

(72) Inventors: Christopher A. Margrave, Ashtabula, OH (US); Michael Messuri, Canfield, OH (US); Nicole L. Liptak, Cortland, OH (US); Dominic A. Messuri, Canfield, OH (US); James Shuster, New Wilmington, PA (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 10 days.

(21) Appl. No.: 17/070,028

(22) Filed: Oct. 14, 2020

(65) Prior Publication Data

US 2022/0115814 A1 Apr. 14, 2022

(51) Int. Cl.
*H01R 13/641* (2006.01)
*H01R 13/627* (2006.01)

(52) U.S. Cl.
CPC ..... *H01R 13/641* (2013.01); *H01R 13/6275* (2013.01)

(58) Field of Classification Search
CPC ... H01R 13/6275; H01R 13/64; H01R 13/641
See application file for complete search history.

(56) References Cited

U.S. PATENT DOCUMENTS

| | | | | |
|---|---|---|---|---|
| 5,236,373 | A | 8/1993 | Kennedy | |
| 5,803,651 | A | 9/1998 | Saito | |
| 5,879,180 | A | 3/1999 | Iwahori et al. | |
| 6,261,116 | B1 | 7/2001 | Ceru | |
| 6,435,895 | B1 | 8/2002 | Fink et al. | |
| 6,780,045 | B2 * | 8/2004 | Shuey | H01R 13/6272 439/352 |
| 2005/0196943 | A1 * | 9/2005 | Ishiwa | H01R 13/641 438/489 |
| 2014/0242823 | A1 * | 8/2014 | Littek | H01R 13/641 439/162 |
| 2017/0250501 | A1 * | 8/2017 | Endo | H01R 13/6271 |
| 2020/0373709 | A1 * | 11/2020 | Schoedel | H01R 13/6272 |
| 2020/0412052 | A1 * | 12/2020 | Menez | H01R 13/639 |

* cited by examiner

*Primary Examiner* — Oscar C Jimenez
(74) *Attorney, Agent, or Firm* — Carlson, Gaskey & Olds, P.C.

(57) ABSTRACT

An electrical connector assembly includes, among other things, a connector that includes a connector lock arm that is cantilevered from one side of the connector to a free end. The connector lock arm has first and second apertures that are separated by a block. The assembly further includes a connector position assurance lock that has a base that supports a wave-shaped center lock arm that is received in the connector lock arm. The center lock arm extends to a nose that has a shoulder. The connector position assurance lock is slidable between unlocked and fully locked positions that respectively correspond to the shoulder arranged in the first and second apertures. The center lock arm has a bend joined to the nose by a portion that is parallel to the connector lock arm in the unlocked and fully locked positions. The center lock arm is configured to be deflected to an improper mating position with the portion arranged non-parallel to the connector lock arm.

18 Claims, 8 Drawing Sheets

WAVE CONNECTOR POSITION ASSURANCE LOCK WITH DUAL OVERLAP CONNECTOR LOCK

FIELD OF INVENTION

This disclosure relates to an electrical connector for use in a wiring harness, for example.

BACKGROUND

Due to the increased demand of data connections in safety systems on vehicles, a robust connector position assurance (CPA) system is necessary to guarantee proper mating and positioning of the connection system and avoid unintentional connector unlocking of first and second connectors. Current connector lock robustness and performance is limited due to package size constraints.

One CPA system disclosed in U.S. Pat. No. 6,261,116 to Ceru uses a CPA lock 12 to lock first and second connectors together when properly mated. The CPA lock 12 is movable with respect to a center lock arm 84 between a unlocked position (FIG. 6) and a fully locked position (FIG. 7). Even with such a CPA system, it is still possible to cause the center lock arm to buckle during an unintentional CPA mate such that proper connector mating is not guaranteed.

SUMMARY

In one exemplary embodiment, an electrical connector assembly includes, among other things, a connector that includes a connector lock arm that is cantilevered from one side of the connector to a free end. The connector lock arm has first and second apertures that are separated by a block. The assembly further includes a connector position assurance lock that has a base that supports a wave-shaped center lock arm that is received in the connector lock arm. The center lock arm extends to a nose that has a shoulder. The connector position assurance lock is slidable between unlocked and fully locked positions that respectively correspond to the shoulder arranged in the first and second apertures. The center lock arm has a bend joined to the nose by a portion that is parallel to the connector lock arm in the unlocked and fully locked positions. The center lock arm is configured to be deflected to an improper mating position with the portion arranged non-parallel to the connector lock arm.

In a further embodiment of any of the above, the connector has spaced apart rails that each provide a channel. The base has spaced apart slides that are each received in a respective channel. Each slide includes a clip and a stop. Each rail includes a recess that receives the clip. The stops are spaced from the rails with the connector position assurance lock in the unlocked position. The stops abut the rails with the connector position assurance lock in a fully locked position.

In a further embodiment of any of the above, the base includes a leg that is arranged between the center lock arm and each of the slides. The legs and the center lock arm extend in a same direction from the base.

In a further embodiment of any of the above, the center lock arm includes first and second bends and first and second portions. The bend is a second bend, and the portion is a second portion. The first bend is arranged at the base. The first portion extends from the first bend to the second bend. The first and second bends and the first and second portions provide the wave-shaped center lock arm.

In a further embodiment of any of the above, the nose includes a notch that defines the shoulder. The block is seated in the notch in the unlocked position.

In a further embodiment of any of the above, the connector includes spaced apart lock tabs that partially overlap the free end. The free end includes spaced apart arms that extend laterally from a central portion. Each arm is arranged beneath a respective lock tab. The arms abut the lock tabs in the improper mating position.

In a further embodiment of any of the above, an opening is defined between the lock tabs. The central portion extends through the opening and between terminal ends of the lock tabs in the improper mating position.

In a further embodiment of any of the above, the connector is a first connector and includes a second connector that has a wall that provides a space. The wall includes a slot that receives the block in a fully seated position. The shoulder is disposed in the slot in a fully locked position.

In a further embodiment of any of the above, the central portion abuts the wall in the fully seated position.

In a further embodiment of any of the above, the wall engages the shoulder in a transition position to deflect the nose inward away from the block.

In another exemplary embodiment, an electrical connector assembly includes a first connector that includes a connector lock arm that is cantilevered from one side of the first connector to a free end. The connector lock arm has first and second apertures that are separated by a block. Spaced apart lock tabs partially overlap the free end. The free end includes spaced apart arms that extend laterally from a central portion. Each arm is arranged beneath a respective lock tab. The arms abut the lock tabs in an improper mating position. The assembly also includes a second connector that has a wall that provides a space. The wall includes a slot that receives the block in a fully seated position. The assembly further includes a connector position assurance lock that has a base that supports a center lock arm that is received in the connector lock arm. The center lock arm extends to a nose that has a shoulder. The connector position assurance lock is slidable between unlocked and fully locked positions that respectively correspond to the shoulder being arranged in the first and second apertures. The shoulder is disposed in the slot in the fully locked position. The center lock arm has a bend that is joined to the nose by a portion that is parallel to the connector lock arm in the unlocked and fully locked positions. The center lock arm is configured to be deflected to the improper mating position with the portion arranged non-parallel to the connector lock arm.

In a further embodiment of any of the above, the center lock arm is wave-shaped. The nose includes a notch that defines the shoulder. The block is seated in the notch in the unlocked position. The wall engages the shoulder in a transition position to deflect the nose inward away from the block.

In a further embodiment of any of the above, an opening is defined between the lock tabs. The central portion extends through the opening and between terminal ends of the lock tabs in the improper mating position.

In a further embodiment of any of the above, the central portion abuts the wall in the fully seated position.

In a further embodiment of any of the above, the connector has spaced apart rails that each provide a channel. The base has spaced apart slides that are each received in a respective channel. Each slide includes a clip and a stop. Each rail includes a recess that receives the clip. The stops are spaced from the rails with the connector position assurance lock in the unlocked position. The stops abut the rails with the connector position assurance lock in the fully locked position. The base includes a leg that is arranged between the center lock arm and each of the slides. The legs and the center lock arm extend in a same direction from the base. The bend is a second bend. The portion is a second portion. A first bend is arranged at the base. A first portion extends from the first bend to the second bend. The first and second bends and the first and second portions provide the center lock arm.

In another exemplary embodiment, a method of assembling an electrical connector includes the steps of pushing first and second connectors together, sliding a connector position assurance lock from an unlocked position, catching a connector lock arm on the first connector with a shoulder of the connector position assurance lock, deflecting the connector lock arm upward along with a wave-shaped center lock arm of the connector position assurance lock, and preventing the connector position assurance lock from moving to a locked position.

In a further embodiment of any of the above, the method includes the steps of fully seating first and second connectors with one another to electrically connected mating terminals by seating a block in a slot in the second connector. The method also includes, again, sliding the connector position assurance lock from an unlocked position. The method further includes, again, deflecting the wave-shaped center lock arm of the connector position assurance lock inward. The method further includes inserting a nose of the wave-shaped center lock arm into the slot in the second connector with the connector position assurance lock in the locked position.

In a further embodiment of any of the above, spaced apart lock tabs partially overlap a free end of the connector lock arm. The free end includes spaced apart arms that extend laterally from a central portion. Each of the spaced apart arms are arranged beneath a respective lock tab. The deflecting step includes abutting the lock tabs with the spaced apart arms in an improper mating position.

In a further embodiment of any of the above, the central portion abuts a wall in a fully seated position.

In a further embodiment of any of the above, an opening is defined between the lock tabs. The central portion extends through the opening and between terminal ends of the lock tabs in the improper mating position.

BRIEF DESCRIPTION OF THE DRAWINGS

The disclosure can be further understood by reference to the following detailed description when considered in connection with the accompanying drawings wherein.

DETAILED DESCRIPTION

Figure 1A:
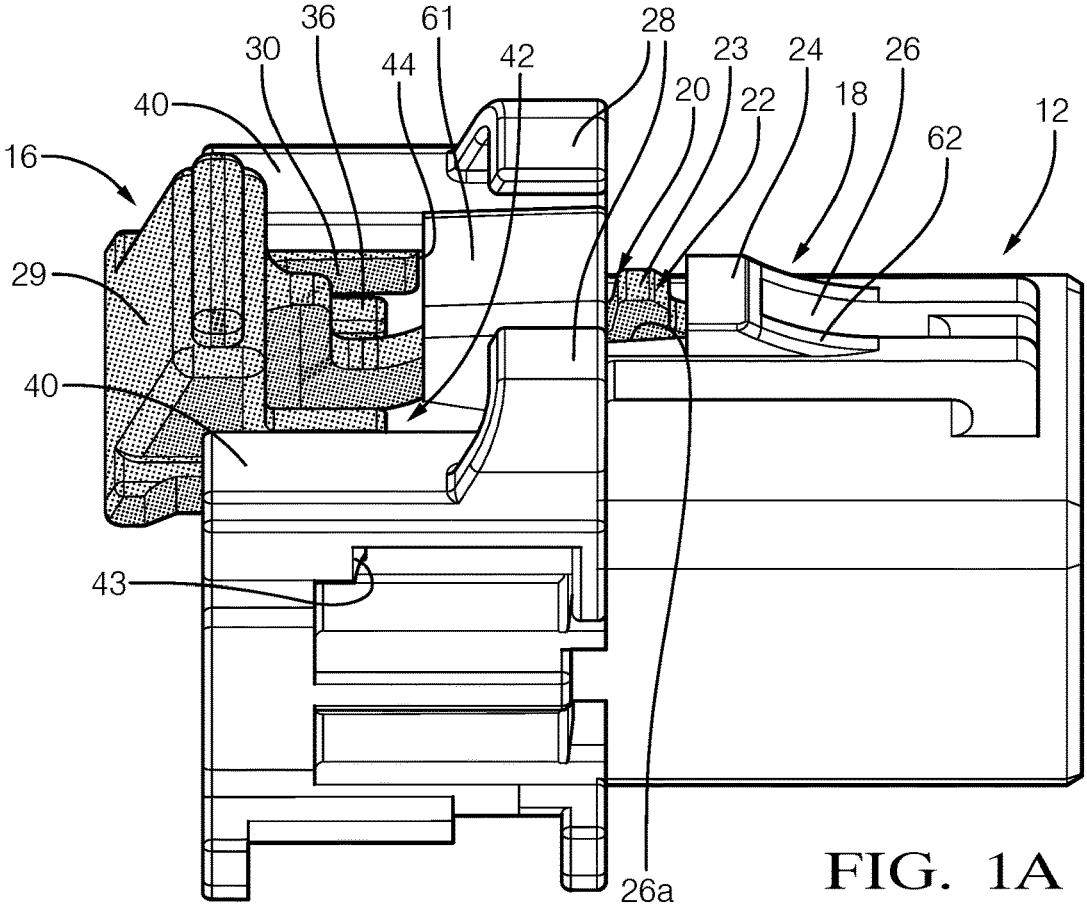
FIG. 1A is perspective view of a first connector with a connector position assurance (CPA) lock in a unlocked position.

A plastic electrical connector assembly 10 (FIGS. 2A-2C and 5) includes a first connector 12 (FIGS. 1A-3 and 6-8) and a second connector 14 (FIGS. 2A-2C and 5) that mate with one another to electrically connect complementary wire terminals in a wiring harness. Typically, one of the connectors carries male terminals, and the other connector carries female terminals. In order to ensure that the terminals have a good electrical connection, full engagement is needed between the first and second connectors 12, 14. A connector position assurance (CPA) lock 16 (FIGS. 1A-7) is used to lock the first and second connectors 12, 14 together—only when fully seated with one another—to ensure electrical continuity between the mating terminals is not compromised during use. The CPA lock 16 should not move to a locked position if the first and second connectors 12, 14 are not fully seated. In this manner, the unlocked CPA lock 16 acts a visual indicator to the assembler that a proper connection has not yet been achieved.

Figure 1C:
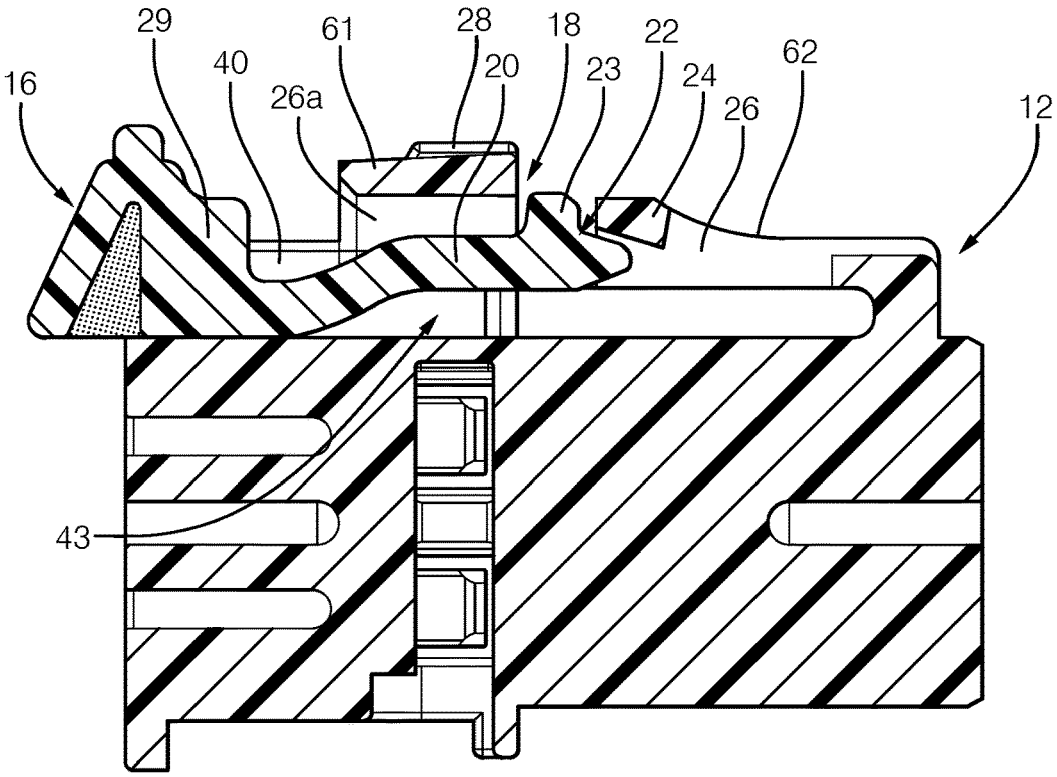
FIG. 1C is a cross-sectional view of the first connector taken along line 1C-1C in FIG. 1B.
Figure 1B:
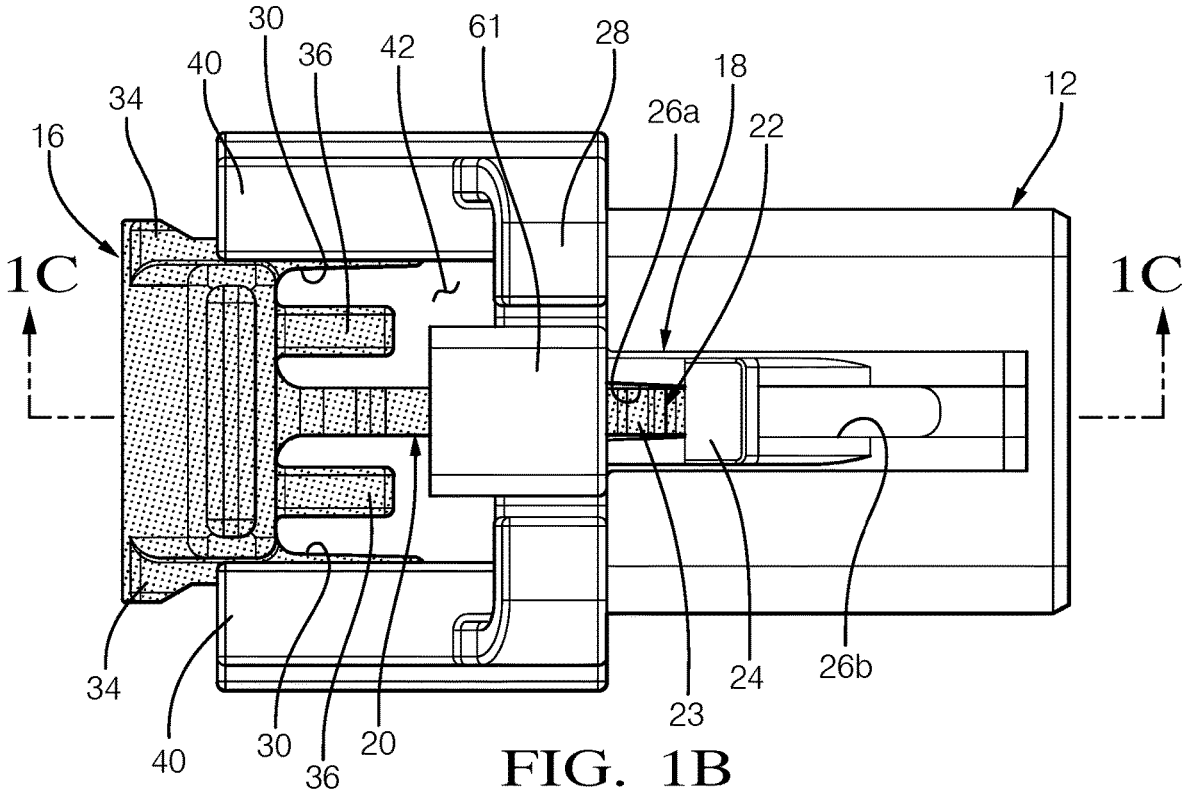
FIG. 1B is an elevational view of the first connector as shown in FIG. 1A.

Referring to FIGS. 1A-1C, the first connector 12 includes a flexible connector lock arm 18 cantilevered from one side of the connector 12 to a free end 61. The connector lock arm 18, which deflects during connector assembly, has first and second apertures 26*a*, 26*b* separated by a block 24.

The CPA lock 16 (FIGS. 4A-4B) has a base 29 supporting a wave-shaped center lock arm 20 received in the connector lock arm 18. The CPA lock 16 is retained with respect to the first connector 12, but is slidable relative thereto between unlocked and locked positions.

The first connector 12 has spaced apart rails 40 that each provide a channel 44, as shown in FIG. 1A. The CPA lock 16 is shown in detail in FIGS. 4A-4B and is arranged in a space 42 between the rails 40. The base 29 has spaced apart slides 30 each received in a respective channel 44. Each slide 30 includes a clip 32 and a stop 34. Each rail 40 includes a recess 43 (FIG. 1C) receiving its clip 32. The stops 34 are spaced from the rails 40 with the CPA lock 16 in the unlocked position. The stops 34 abut the backside of the rails 40 with the CPA lock 16 in the fully locked position. The base 29 includes a leg 36 arranged between the center lock arm 20 and each of the slides 30. The legs 36 and the center lock arm 20 extend in a same direction from the base 29 and operate to stabilize the CPA lock 16 during sliding movement.

Figure 3:
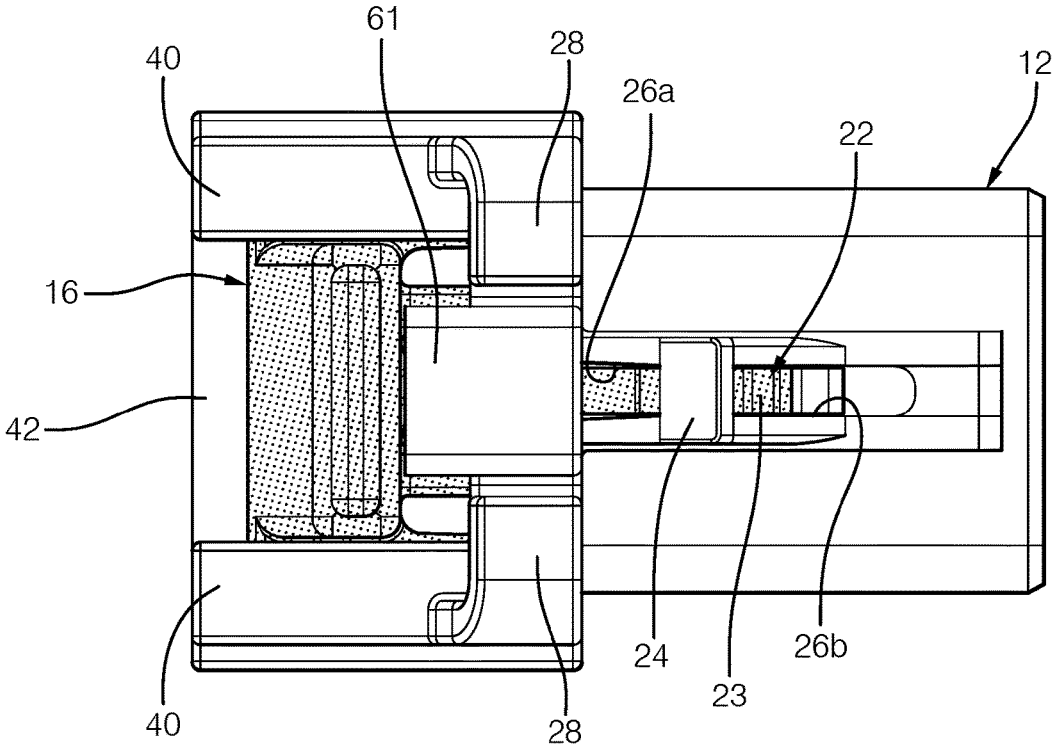
FIG. 3 is an elevation view of the first connector similar to that of FIG. 1B, but with the CPA lock in a fully locked position.

The center lock arm 20 has a first bend 50 arranged at the base 29. A first portion 46 extends from the first bend 50 to a second bend 52. Each of the first and second bends 50, 52 are arcuate in shape. The second bend 52 is joined to the nose 22 by a second portion 48 that is parallel to the connector lock arm 18 in the unlocked position (FIGS. 1A-1C and 2A) and fully locked positions (FIGS. 2C and 3). The center lock arm 20 is configured to be deflected to an improper mating position (FIGS. 6-8) with the second portion 48 arranged non-parallel to the connector lock arm 18. The first and second bends 50, 52 and the first and second portions 46, 48 provide the wave-shaped, or S-shaped center beam geometry for the connector lock arm 18.

Referring to FIGS. 1A and 1C, the center lock arm 20 extends to a nose 22 that has a notch defining a shoulder 23. The CPA lock 16 is slidable between the unlocked position (FIGS. 1A-1C and 2A) and a fully locked position (FIGS. 2C and 3) respectively corresponding to the shoulder 23 being arranged in the first and second apertures 26*a*, 26*b*. The block 24 is seated in the notch in a unlocked position, best shown in FIG. 1C.

Figure 2A:
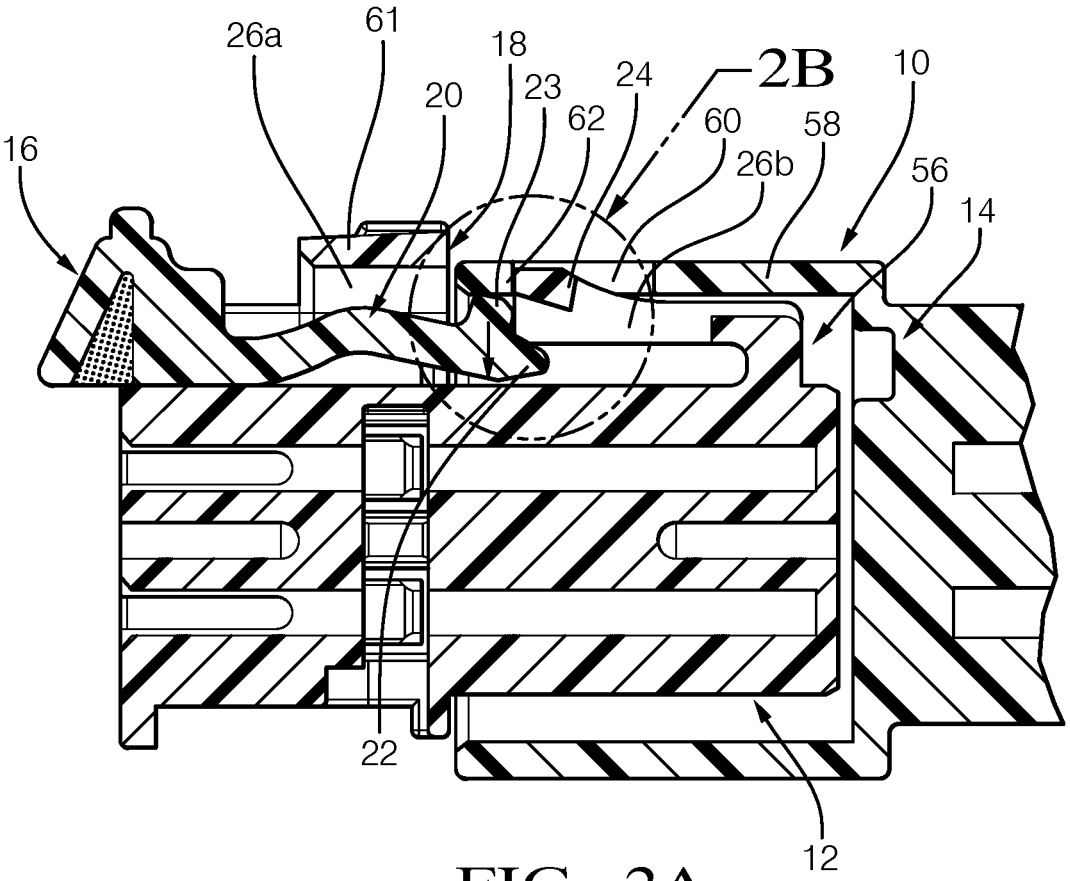
FIG. 2A is a cross-sectional view of the first connector and a second connector of an electrical connector in a fully seated position relative to one another and with the CPA lock in a unlocked position similar to FIG. 1C.
Figure 2B:
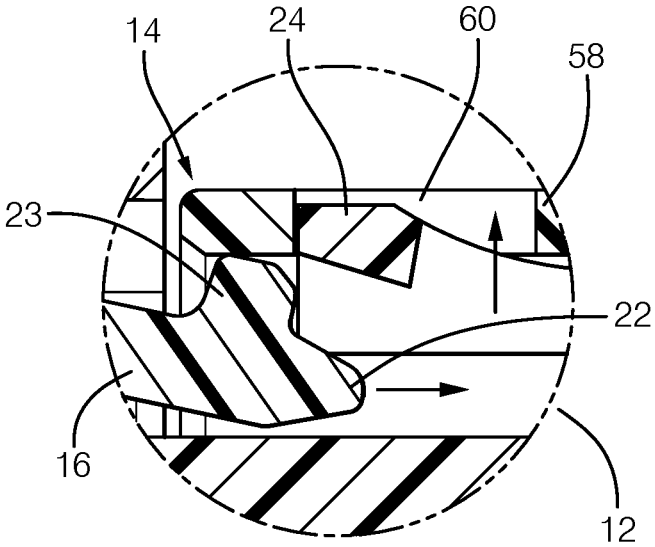
FIG. 2B is a partial cross-sectional view of the electrical connector with the CPA lock between the unlocked position and a fully locked position.
Figure 2C:
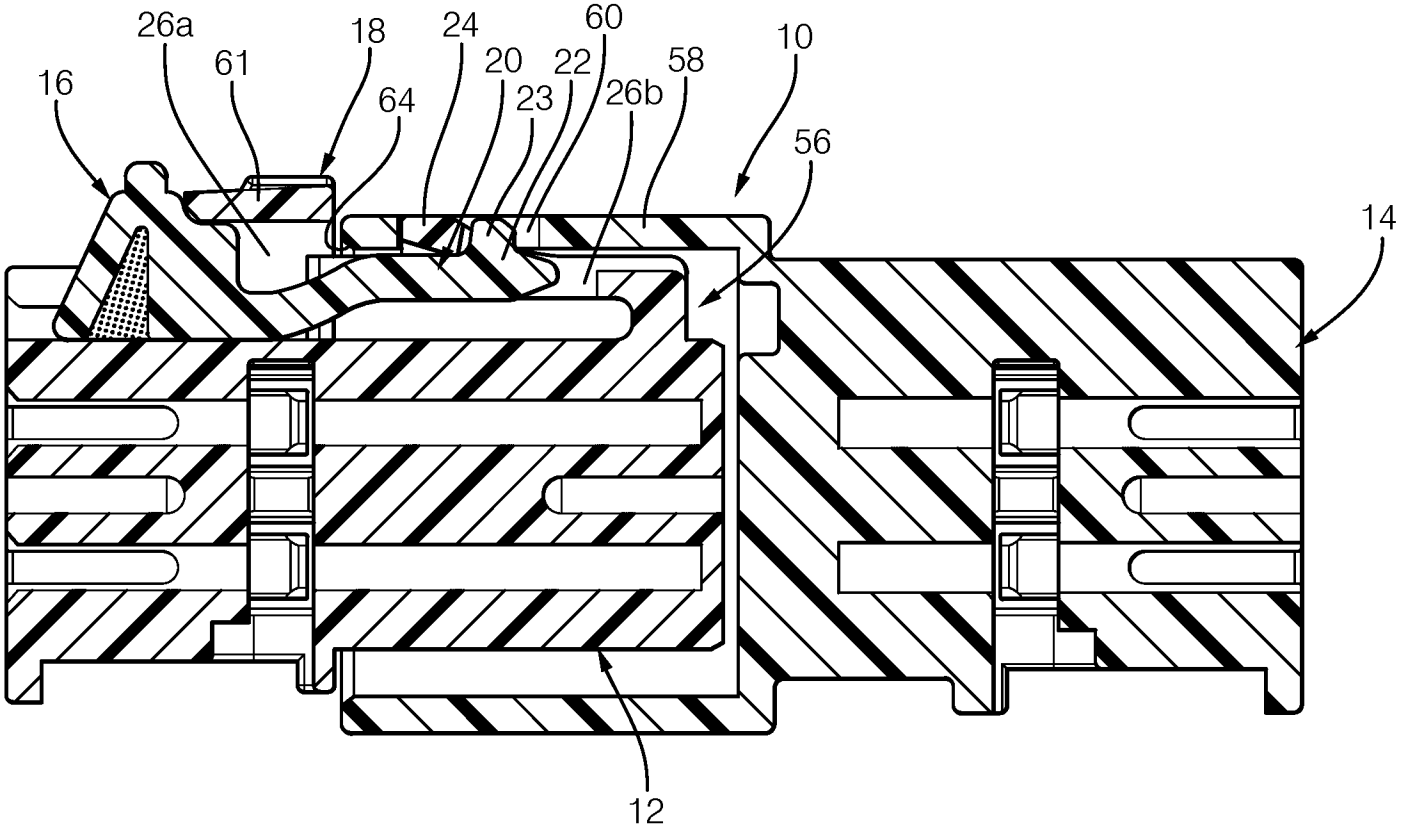
FIG. 2C is a cross-sectional view of the electrical connector shown in FIG. 2A, but with the CPA lock in the fully locked position.
Figure 4A:
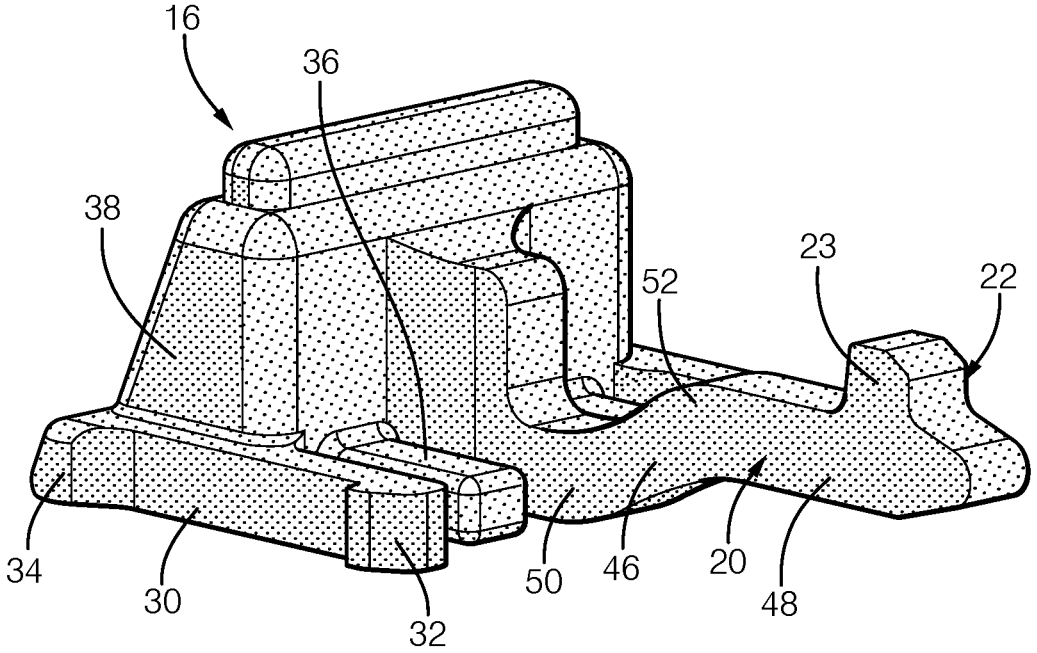
FIG. 4A is a perspective view of the CPA lock.
Figure 4B:
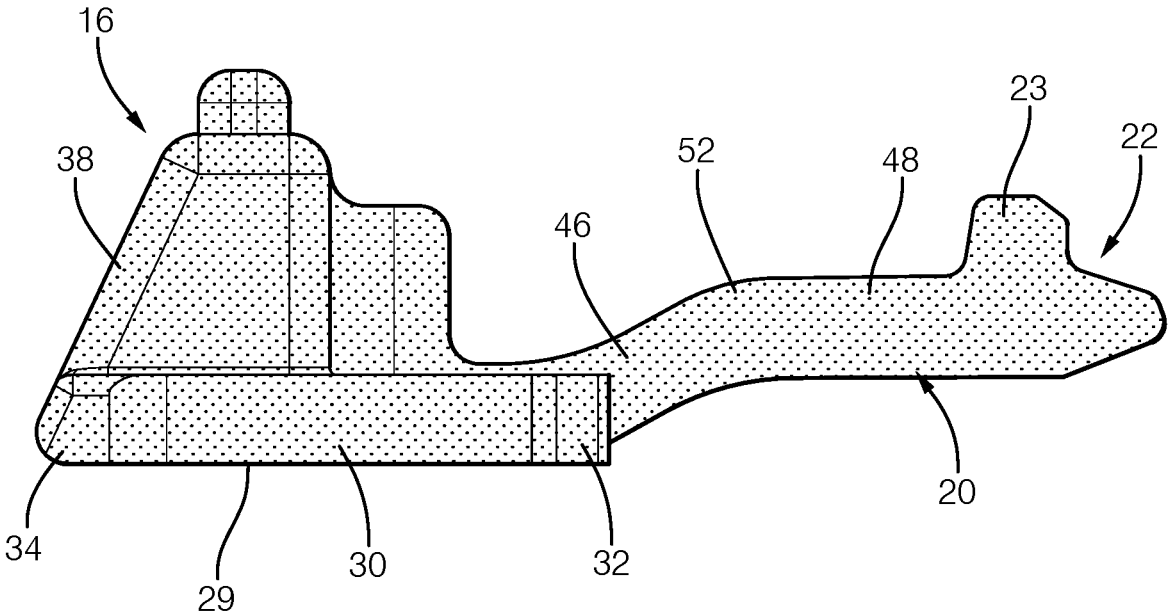
FIG. 4B is a side view of the CPA lock.

Referring to FIGS. 2A-2C, the second connector 14 has a wall 58 providing a space 56. During connector assembly, the first connector 12 is inserted into the space 56 of the second connector 14. The first and second connectors 12, 14 are pushed together, and the connector lock arm 18 is deflected inward as the end 64 of the wall 58 slides along a ramped surface 62 (FIGS. 1A, 1C and 2A) until the central portion of the free end 61 abuts and end 64 the wall 58. In this fully seated position, a slot 60 in the wall 58 receives the block 24, and the connector lock arm 18 returns to a relaxed position, as shown in a FIG. 2A.

To further maintain the first and second connectors 12, 14 in engagement with one another, the CPA lock 16 is slid from the unlocked position (FIG. 2A) to the locked position FIG. 2C). As shown in FIG. 2B, the tapered surface of the nose 22 begins to force the nose 22 inward and below the wall 58 until the shoulder 23 drops below the wall 58, deflecting the nose 22 inward away from the block 24. The inward deflection of the center lock arm 20 is facilitated by its wave shape. The wall 58 reinforces the connector lock arm 18 and prevents the connector lock arm 18 from being deflected outward, enabling the shoulder 23 to be slid into the slot 60 in the fully locked position shown in FIG. 2C.

Figure 5:
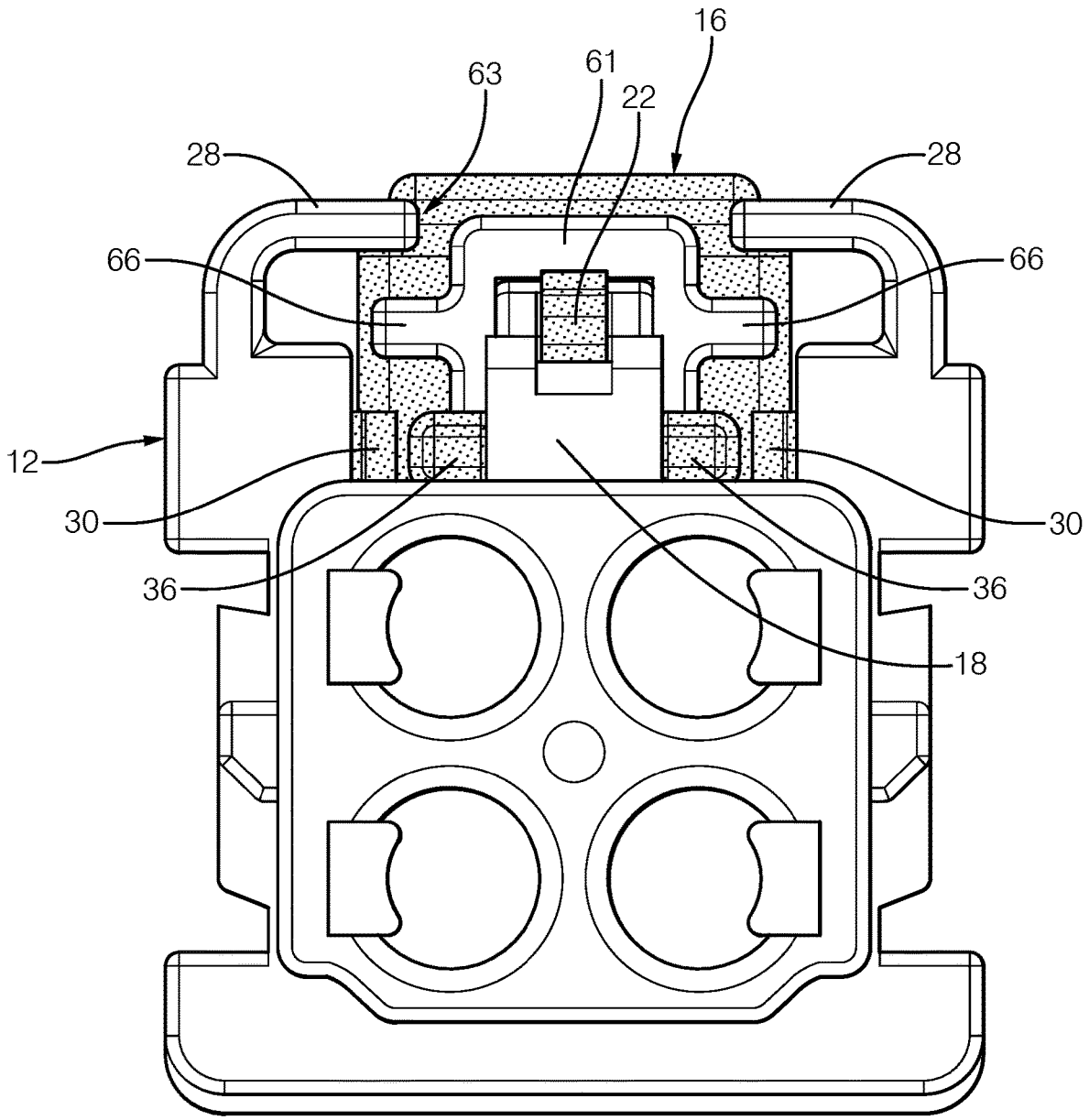
FIG. 5 is an end view of the assembled connector shown in FIG. 1B.

Referring to FIG. 5, the first connector 12 includes spaced apart lock tabs 28 partially overlapping the free end 61 of the center lock arm 20. In the example configuration, an opening 63 is defined between the lock tabs 28. The free end 61 includes spaced apart arms 66 extending laterally from a central portion of the free end 61. Each arm 66 is arranged beneath a respective lock tab 28.

Figure 6:
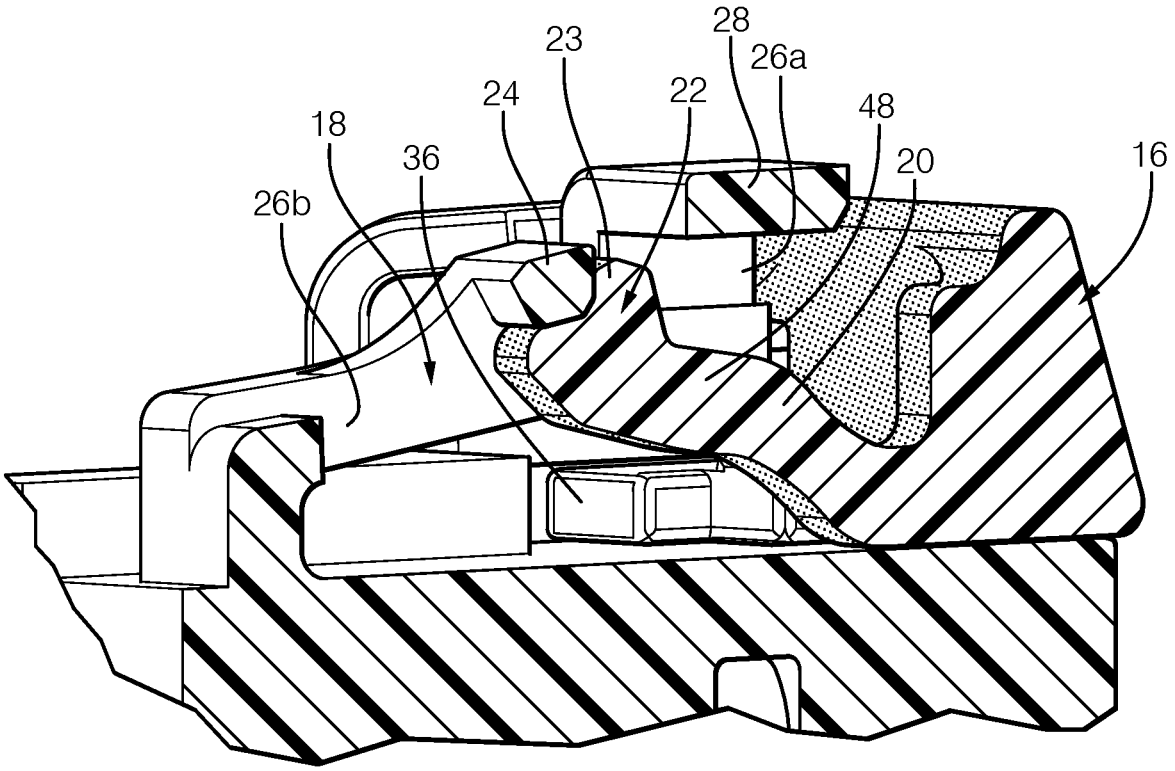
FIG. 6 is an enlarged, partial cross-sectional view illustrating the CPA lock in an improper mating position.
Figure 7:
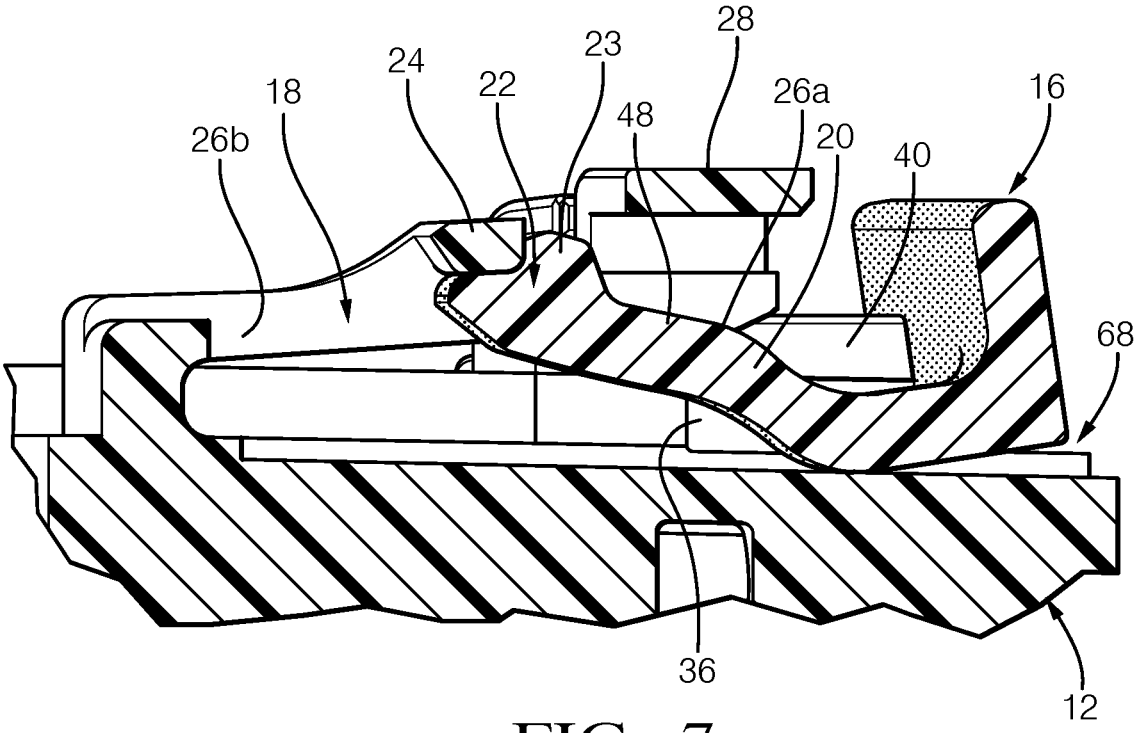
FIG. 7 is another cross-sectional view depicting the CPA lock in the improper mating position.
Figure 8:
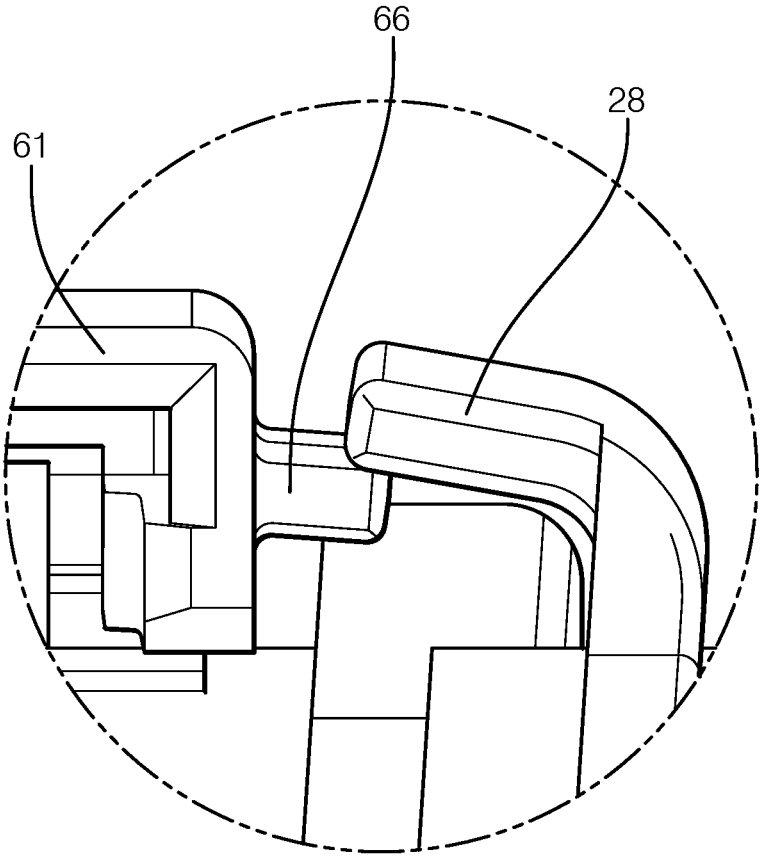
FIG. 8 is a cross-sectional view depicting a deformed lock tab with the CPA lock in the improper mating position.

If the first and second connectors 12, 14 are not fully seated with one another, the CPA lock 16 will not be able to move to the locked position. The block 24 will not be fully received in the slot 60 when the first and second connectors 12, 14 are not fully seated, i.e. an improper mating position. Moreover, the end 64 of the wall will not be flush with the block 24. As a result, in an attempt to slide the CPA lock 16 from the unlocked position to the locked position, the connector lock arm 18 will be deflected upward as the shoulder 23 catches the block 24, as shown in FIGS. 6 and 7. The base 29 may lift off of the first connector 12, creating a gap 68, as shown in FIG. 7. At the same time, the arms 66 will abut the lock tabs 28 in the improper mating position, as shown in FIG. 8. In this improper mating position, the central portion of the free end 61 extends through the opening 63 and between terminal ends of the lock tabs 28.

Due to package size constraints, the connector lock arm 18 does not have sufficient column strength to prevent unintentional seating of the CPA in a purely linear direction. To this end, the disclosed features of the CPA lock 16 work integrally with the connector lock arm 18 to increase blocking force and prevent unintentional seating by combining an upward and linear deflection. The CPA nose design provides upward force against connector lock arm 18, via the block 24. The design of the nose 22 provides linear force against connector lock arm block 24. Overlapping connector side arms interact with connector lock tabs, providing additional downward force to prevent connector lock arm from buckling during an unintentional CPA mate.

During proper CPA mating, i.e., the locked position, the wave-shaped center beam geometry provides reduced engagement and adequate deflection with minimal strains while the CPA lock transitions from the unlocked position to the fully seated position.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An electrical connector assembly comprising:

a connector including a connector lock arm cantilevered from one side of the connector to a free end, the connector lock arm having first and second apertures separated by a block; and a connector position assurance lock having a base supporting a wave-shaped center lock arm received in the connector lock arm, the center lock arm extending to a nose that has a shoulder, wherein the connector position assurance lock is slidable between unlocked and fully locked positions respectively corresponding to the shoulder being arranged in the first and second apertures, the center lock arm having a bend joined to the nose by a portion that is parallel to the connector lock arm in the unlocked and fully locked positions, the center lock arm is configured to be deflected to an improper mating position with the portion arranged non-parallel to the connector lock arm, wherein the center lock arm comprises first and second bends and first and second portions, the bend is a second bend, and the portion is a second portion, the first bend arranged at the base, the first portion extending from the first bend to the second bend, the first and second bends and the first and second portions providing the S-shaped center lock arm.

2. The assembly of claim 1, wherein the connector has spaced apart rails that each provide a channel, and the base has spaced apart slides each received in a respective channel, each slide includes a clip and a stop, each rail includes a recess receiving the clip, the stops are spaced from the rails with the connector position assurance lock in the unlocked position, and the stops abut the rails with the connector position assurance lock in the fully locked position.

3. The assembly of claim 1, wherein the nose includes a notch defining the shoulder, the block seated in the notch in the unlocked position.

4. The assembly of claim 1, wherein the connector is a first connector, and comprising a second connector having a wall providing a space, the wall includes a slot receiving the block in a fully seated position, and the shoulder is disposed in the slot in a fully locked position.

5. The assembly of claim 4, wherein a central portion abuts the wall in the fully seated position.

6. The assembly of claim 4, wherein the wall engages the shoulder in a transition position to deflect the nose inward away from the block.

7. An electrical connector assembly comprising:

a connector including a connector lock arm cantilevered from one side of the connector to a free end, the connector lock arm having first and second apertures separated by a block; and a connector position assurance lock having a base supporting a wave-shaped center lock arm received in the connector lock arm, the center lock arm extending to a nose that has a shoulder, wherein the connector position assurance lock is slidable between unlocked and fully locked positions respectively corresponding to the shoulder being arranged in the first and second apertures, the center lock arm having a bend joined to the nose by a portion that is parallel to the connector lock arm in the unlocked and fully locked positions, the center lock arm is configured to be deflected to an improper mating position with the portion arranged non-parallel to the connector lock arm, wherein the connector has spaced apart rails that each provide a channel, and the base has spaced apart slides each received in a respective channel, each slide includes a clip and a stop, each rail includes a recess receiving the clip, the stops are spaced from the rails with the connector position assurance lock in the unlocked position, and the stops abut the rails with the connector position assurance lock in the fully locked position, wherein the base includes a leg arranged between the center lock arm and each of the slides providing a pair of legs, each of the legs extending to another free end, the legs and the center lock arm extending in a same direction from the base.

8. An electrical connector assembly comprising:

a connector including a connector lock arm cantilevered from one side of the connector to a free end, the connector lock arm having first and second apertures separated by a block; and a connector position assurance lock having a base supporting a wave-shaped center lock arm received in the connector lock arm, the center lock arm extending to a nose that has a shoulder, wherein the connector position assurance lock is slidable between unlocked and fully locked positions respectively corresponding to the shoulder being arranged in the first and second apertures, the center lock arm having a bend joined to the nose by a portion that is parallel to the connector lock arm in the unlocked and fully locked positions, the center lock arm is configured to be deflected to an improper mating position with the portion arranged non-parallel to the connector lock arm, wherein the connector includes spaced apart lock tabs partially overlapping the free end, the free end including spaced apart arms extending laterally from a central portion, each arm arranged beneath a respective lock tab, the arms abutting the lock tabs in the improper mating position.

9. The assembly of claim 8, wherein an opening is defined between the lock tabs, and the central portion extends through the opening and between terminal ends of the lock tabs in the improper mating position.

10. An electrical connector assembly comprising:

a first connector including a connector lock arm cantilevered from one side of the first connector to a free end, the connector lock arm having first and second apertures separated by a block, spaced apart lock tabs partially overlapping the free end, the free end including spaced apart arms extending laterally from a central portion, each arm arranged beneath a respective lock tab, the arms abutting the lock tabs in an improper mating position;

a second connector having a wall providing a space, the wall includes a slot receiving the block in a fully seated position; and a connector position assurance lock having a base supporting a center lock arm received in the connector lock arm, the center lock arm extending to a nose that has a shoulder, wherein the connector position assurance lock is slidable between unlocked and fully locked positions respectively corresponding to the shoulder being arranged in the first and second apertures, the shoulder is disposed in the slot in the fully locked position, the center lock arm having a bend joined to the nose by a portion that is parallel to the connector lock arm in the unlocked and fully locked positions, the center lock arm is configured to be deflected to the improper mating position with the portion arranged non-parallel to the connector lock arm.

11. The assembly of claim 10, wherein the center lock arm is wave-shaped, and the nose includes a notch defining the shoulder, the block seated in the notch in the unlocked position, and the wall engages the shoulder in a transition position to deflect the nose inward away from the block.

12. The assembly of claim 11, wherein an opening is defined between the lock tabs, and the central portion extends through the opening and between terminal ends of the lock tabs in the improper mating position.

13. The assembly of claim 11, wherein the central portion abuts the wall in the fully seated position.

14. The assembly of claim 10, wherein the connector has spaced apart rails that each provide a channel, and the base has spaced apart slides each received in a respective channel, each slide includes a clip and a stop, each rail includes a recess receiving the clip, the stops are spaced from the rails with the connector position assurance lock in the unlocked position, and the stops abut the rails with the connector position assurance lock in the fully locked position, the base includes a leg arranged between the center lock arm and each of the slides, the legs and the center lock arm extending in a same direction from the base, the bend is a second bend, and the portion is a second portion, a first bend arranged at the base, a first portion extending from the first bend to the second bend, the first and second bends and the first and second portions providing the center lock arm.

15. A method of assembling an electrical connector comprising the steps of:

pushing first and second connectors together;

sliding a connector position assurance lock from an unlocked position;

catching a connector lock arm on the first connector with a shoulder of the connector position assurance lock;

deflecting the connector lock arm upward along with a wave-shaped center lock arm of the connector position assurance lock;

preventing the connector position assurance lock from moving to a locked position; and wherein spaced apart lock tabs partially overlap a free end of the connector lock arm, the free end including spaced apart arms extending laterally from a central portion, each of the spaced apart arms arranged beneath a respective lock tab, the deflecting step includes abutting the lock tabs with the spaced apart arms in an improper mating position.

16. The method of claim 15, comprising the steps of:

fully seating first and second connectors with one another to electrically connected mating terminals by seating a block in a slot in the second connector;

again, sliding the connector position assurance lock from an unlocked position;

again, deflecting the wave-shaped center lock arm of the connector position assurance lock inward; and inserting a nose of the wave-shaped center lock arm into the slot in the second connector with the connector position assurance lock in the locked position.

17. The method of claim 15, wherein the central portion abuts a wall in a fully seated position.

18. The method of claim 15, wherein an opening is defined between the lock tabs, and the central portion extends through the opening and between terminal ends of the lock tabs in the improper mating position.

* * * * *